US006916192B2

(12) United States Patent
Gräff et al.

(10) Patent No.: US 6,916,192 B2
(45) Date of Patent: Jul. 12, 2005

(54) CONTROL DEVICE

(75) Inventors: Uwe Gräff, Ostfildern (DE); Hannes Wirtl, Schongau (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/797,799

(22) Filed: Mar. 10, 2004

(65) Prior Publication Data

US 2004/0198086 A1 Oct. 7, 2004

(30) Foreign Application Priority Data

Apr. 1, 2003 (EP) ..... 03007328

(51) Int. Cl.[7] ..... H01R 4/60
(52) U.S. Cl. ..... 439/191; 439/248
(58) Field of Search ..... 439/191, 190, 439/192, 193, 194, 195, 246, 247, 248; 451/287, 8

(56) References Cited

U.S. PATENT DOCUMENTS 4,165,139 A * 8/1979 Asbill, III ..... 439/191
4,352,532 A * 10/1982 Hardin ..... 439/191
4,507,707 A 3/1985 Willis
4,899,822 A * 2/1990 Daeschler et al. ..... 166/339
6,234,815 B1 * 5/2001 Omiya et al. ..... 439/191

FOREIGN PATENT DOCUMENTS

| | | |
|---|---|---|
| EP | 0 629 783 A1 | 12/1994 |
| EP | 1 180 602 A | 2/2002 |
| EP | 1 207 329 A1 | 5/2002 |
| WO | WO 01/42664 A2 | 6/2001 |

* cited by examiner

*Primary Examiner*—Hien Vu
(74) *Attorney, Agent, or Firm*—Hoffmann & Baron, LLP

(57) ABSTRACT

A control device having a base which is provided with one or more component mounting areas. On each component mounting area there is a first electrical central interface connected with an internal electrical bus. On each component mounting area an electrical connection module or an electrically controlled fluid control module may be selectively mounted, which respectively has a second central interface complementary to the first electrical central interface. The fluid control module is provided with a valve means, which is controlled by signals supplied by means of the internal electrical bus. The connection modules are provided with inputs and/or outputs for the connection of electrical cables.

13 Claims, 1 Drawing Sheet

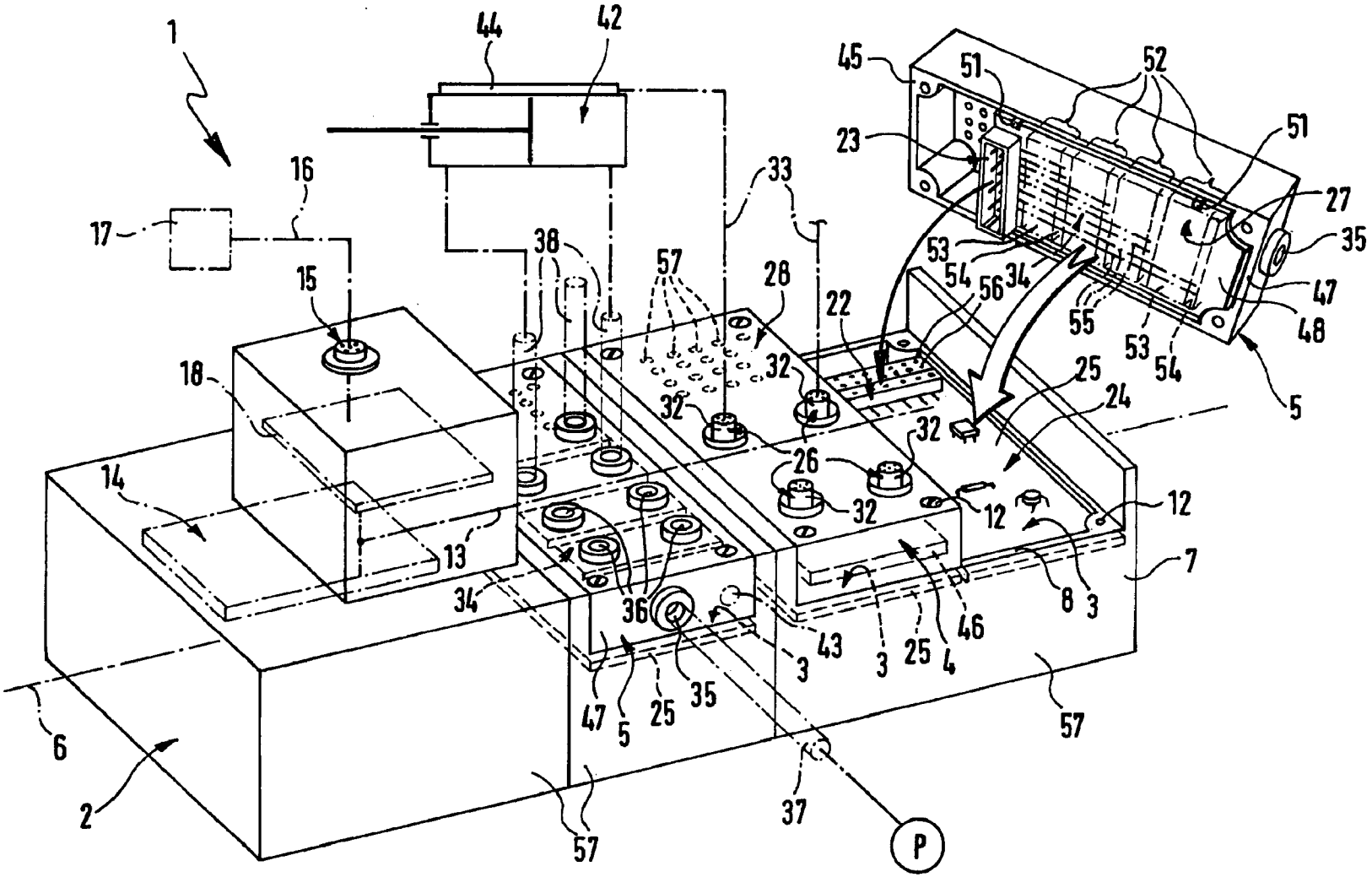
1
2
3
4
5
6
7
8
12
13
14
15
16
17
18
22
23
24
25
26
27
28
32
33
34
35
36
37
38
42
43
44
45
46
47
48
51
52
53
54
55
56
57
P

CONTROL DEVICE

BACKGROUND OF THE INVENTION

The invention relates to control device comprising a base, on which at least one component mounting area is provided, which is equipped with a first electrical central interface connected with an internal electrical bus extending in the base, and at least one electrical connection module having electrical inputs and/or outputs permitting a temporary connection of electrical cables, which lead away from the control device, such connection module being able to be mounted on the at least one component mounting area and having a second electrical central interface adapted, as regards the mounting and removal of the electrical connection module, to automatically make contact and, respectively, interrupt contact with respect to the first electrical central interface.

THE PRIOR ART

A known control device disclosed in the patent publication WO 01/42664 A2 of this type has on a longitudinal side several identical component mounting areas on a base, which are each equipped with a first central interface which is jointly connected with an internal bus. On each component mounting area an electrical connection module may be mounted which is equipped with electrical inputs and/or outputs and which possesses a second electrical central interface adapted to suit the first electrical central interface. Since connection modules are provided, whose inputs and/or outputs are equipped with different designs of connection means, the control device may be extremely flexibly adapted by the selective use of different connection modules as required by the user for his existing connection technology. In addition with the known control device there is the possibility of arranging a valve part on the base at the end, such valve part comprising a plurality of valves collected in a cluster or battery and also connected with the internal bus. However, the measures to render possible the connection of the valves lead to a substantial increase in price of the control device.

SHORT SUMMARY OF THE INVENTION

One object of the invention is to provide a control device of the type initially mentioned, in the case of which the complexity of the technical valve features necessary for the installation is reduced.

In order to achieve these and/or other objects appearing from the present specification, claims and drawings, in the present invention with a control device having the said features there is the inclusion of at least one additional electrically controlled fluid control module, which may be mounted selectively instead of an electrical connection module on the at least one component mounting area and which possesses a second electrical central interface adapted during fitting and removal of the fluid control module, as regards the first electrical central interface of the respective area, to also automatically make contact and, respectively, interrupt contact, the fluid control module furthermore having fluid line connections accessible from the outside for the temporary connection of fluid lines coming from a pressure source and fluid lines leading to at least one load, and moreover possesses an electrically operated valve means, which on the basis of control signals communicated by way of the internal bus can control the connection between different ones of such fluid line connections.

The control device now renders it possible to selectively and interchangeably mount at one and the same component mounting area an electrical connection module or an electrically operated fluid control module equipped with an electrically operated valve means. The control device may possess several identical component mounting areas, which respectively are able to carry either a connection module or a fluid control module so that the control device may be extremely adaptably modified as regards the technical requirements in an individual case. Since for the fluid control module no separate component mounting area is necessary, the production of the control device is extremely economic. Moreover it is an advantage that the fluid control module not only possesses fluid line connections permitting the connection of at least one load but also at least one further fluid line connection by way of which through a fluid line fluid coming from a pressure source may be introduced so that the base of the control device itself does not require any internal fluid ducts. In addition there is the possibility, in the case of the simultaneous installation of a plurality of fluid control modules, to provide for a mutually independent operation of such fluid control modules each having a different operating pressure.

Further advantageous developments of the invention are defined in the claims.

Preferably a plurality of preferably identical component mounting areas are provided on the base each having a first electrical central interface which are able to selectively carry a connection module or a fluid control module. The component mounting areas are preferably arranged in a row direction one after the other in sequence and in a common plane of extent. The latter feature means convenient fitting in place and removal of the individual modules from the same side.

A particularly reliable measure for making contact is the design of the electrical central interfaces as mutually complementary plug connectors.

The connection and fluid control modules are more especially so designed that they each may be mounted, with their bottom side to the fore, on the respective component mounting area, the second electrical central interface being located on the bottom side. All load fluid line connections serving for the mounting of one or more loads are in this case preferably located on the readily accessible top side of the respective fluid control module. The at least one feed fluid line connection present, by way of which fluid coming from a pressure source is fed, is preferably placed laterally on the fluid control module.

The valve means preferably possesses a multiple arrangement of valve units, which are respectively composed of a principal valve controlling the load fluid line connections and at least one electrically operated pilot valve serving for operation of the principal valve. The control signal for the operation of the pilot valve are supplied by way of first and second central interfaces, in mutual contact with each other, from the electrical bus of the control device. There is the possibility, given a suitable technical design of the valves, to operate a plurality of loads, as for example drives, independently from each other by way of a single fluid control module.

Particularly compact dimensions become possible if the pilot valves are in the form of piezoelectric valves.

All connection and fluid control modules preferably possess identically designed module housings, which, dependent on the type of module, are provided with suitably adapted electrical or fluid connection means.

The electrical bus of the base is connected with an electronic central unit located on the control device. At least one electrical interface of the control device renders possible connection of the electronic central unit with an external electrical control means, the electrical interface being for example in the form of a multi-pole interface for the connection of an external parallel bus or in the form of a field bus interface rendering possible the connection of a serial bus. In the case of need the electronic central unit may contain a memory programmable control (SPS).

Further advantageous developments and convenient forms of the invention will be understood from the following detailed descriptive disclosure of one embodiment thereof in conjunction with the single figure of the accompanying drawing.

BRIEF DESCRIPTION OF THE DRAWING

FIG. 1 is a perspective view of the control device formed in according with the present invention.

DETAILED DESCRIPTION OF THE INVENTION

The control device generally referenced 1 comprises a base 2, on which a plurality of component mounting areas 3 are provided, on which selectively an electrical connection module 4 or an electrically control fluid control module 5 are able to be mounted temporarily, i.e. detachably. In the working embodiment the base 2 is provided with in all three component mounting areas 3, one thereof bearing an electrical connection module 4, a further one bearing a fluid control module 5 and the third component mounting area 3 being unoccupied so far and a second fluid control module 5 is depicted just in the course of being installed on the third component mounting area 3.

The base 2 of the working embodiment has an elongated shape with a principal axis 6 extending in the longitudinal direction. The component mounting areas 3 are identical in design and are arranged in a row direction running in the direction of the principal axis 6 on the base. The component mounting areas 3 are preferably in a common plane of extent.

The base 2 possesses a housing termed the base housing 7, which is closed off but not at the component mounting areas 3. The modules 4 and 5 however perform, in the mounted state, a cover function and accordingly close off the base housing 7 at the component mounting areas 3 as well.

At each component mounting area 3 the base housing 7 defines a support face 8 on which the respectively mounted module 4 and 5 rests. Mutually cooperating attachment means 12 render possible a detachable attachment to the housing of the respective module 4 and 5. In the working embodiment illustrated these attachment means 12 constitute individual screw connections. However it is readily possible to have designs which for example permit a detachable detent fixation.

In the interior of the base housing 7 there extends an electrical bus 13 indicated in chained lines. In the working embodiment it extends in the direction of the principal axis 6, it starting at an electronic central unit 14 (accommodated in the base housing 7) and running along all component mounting areas 3.

An electrical interface 15, accessible from the outside, of the base 2 is internally connected with the electronic central interface 14 electrically and renders possible, by way of an intermediate cable 16, if required the connection of an external electronic control means 17. In the working embodiment the electrical interface 15 is designed in the form of a field bus interface, the base 2 being provided with field bus communication unit 18, which receives control signals, supplied in serial transmission technology, from the external electronic control means 17 and processes them before passing same on to the internal electrical bus 13. The internal electrical bus 13 may also be designed in the form of a serial bus.

The field bus communication unit 18 can also be in the form of a component of the electronic central unit 14.

It is readily possible for the electrical interface 15 and the electronic central unit 14 to be so designed that signals supplied in parallel communication technology may be transmitted and processed. The electrical interface 15 may in this case be more particularly a multi-pole plug connector.

At each component mounting area 3 first electrical central interface 22 is arranged, which is in electrical contact with the internal bus 13. It is stationarily secured in relation to the base 2. Preferably the connection with the internal bus 13 is by way of electronic circuitry 24, which more especially comprises converting electronic circuitry and which in the working example is formed on a circuit board 25 installed at the respective component mounting area 3 in the base housing 7.

Although this is not illustrated in detail, the internal bus 13 possesses a plurality of parallel electrical conductors extending in the direction of the principal axis 6 in the interior of the base housing 7, each circuit board 25 having on its bottom side a plurality of connection means, not illustrated either, which bring about the desired electrical connection between the electrical conductors of the internal bus 13 and the electronic circuitry 24 and accordingly with the first electrical central interface 22. The arrangement is more especially such that the electronic circuitry 24 may be plugged in a detachable fashion into the base housing 7, the desired making of electrical contact taking place simultaneously with the internal bus 13.

The first electrical central interface 22 is located on the top side, facing the opening in the base housing 7, of the circuit board 25 and is accordingly accessible through the corresponding opening in the base housing 7 when the module 4 and 5 is removed.

The individual component mounting areas 3 are provided with mutually identical first electrical central interfaces 22, which are mounted at the same position and face in the same direction as one another. In a similar fashion each connection module 4 and each fluid control module 5 is provided with a second electrical central interface 23, complementary to the first electrical central interface 22, the placement on the respective module 4 and 5 being such that each connection module 4 and each fluid control module 5 being able to be installed selectively on each of the component mounting areas present with a simultaneous electrical connection of the associated first and second electrical central interfaces 22 and 23. As regards the site of mounting the modules 4 and 5 are not limited to particular component mounting areas 3.

The first and the second electrical central interfaces 22 and 23 are so designed that on placing the respective modules 4 and 5 on the component mounting area 3 there is an automatic making of electrical contact. In a corresponding fashion the electrical contact is automatically interrupted when the respective module 4 and 5, possibly after operation of the attachment means 12, is taken from the component mounting area 3. It has been shown to be advantageous to design the first and second electrical central interfaces 22 and 23 as mutually complementary plug connectors. Alternatively, for example, contact means would be possible as well, which are simply thrust together and not fitted into each other.

The assembly or fitting of the modules 4 and 5 on the component mounting areas 3 is performed with their bottom side 27 to the fore. On this bottom side 27 the respective second electrical central interface 23 is provided.

The respective electrical connection module 4 possesses a plurality of electrical inputs and/or outputs 26 more particularly arranged on the top side 28 opposite to the bottom side 27. Same are provided connection means 32, which render possible the temporary or detachable connection of electric cables 33 only indicated in chained lines. It is possible to make available a plurality of electrical connection modules 4 simultaneously, which differ from each other as regards the design of the connection means 32 in order to take into account specific customer connection requirements. Accordingly should the user of the control device require individually differently designed connection means 32—more particularly owing to already existing electrical installation features—there is the possibility of adapting the base 2 on each component mounting area 3 selectively using different electrical connection modules 4, which have mutually differently designed electrical connection means 32. There is accordingly the possibility of customizing the control device 1 individually with only a small amount of complexity to obtain the desired connection technology for the inputs and/or outputs 26.

The fluid control modules 5 are respectively provided with a preferably internally mounted electrically operated valve means 34, which is in a position of controlling the connection between at least one feed line fluid connection 35 and a plurality of load fluid line connections 36 in a manner dependent on control signals supplied by way of the internal bus 13, which fluid line connections are all provided on the respective fluid control module 5. The feed fluid line connection 35 renders possible the detachable connection of a first fluid line 37 coming from a pressure source P. Each load fluid line connection 26 permits the detachable connection of a second fluid line 38, which leads to a load illustrated for example at 42. The load 42 is for instance a fluid power drive.

Each fluid control module 5 may furthermore be fitted with at least one venting connection 43 indicated in chained lines, which more particularly renders possible the central removal of the fluid returning from the connected loads in the system. If the valve means 34 is operated with compressed air, the venting connection 43 will be a venting connection, with which for example a muffler or a venting line may be connected.

In the working embodiment illustrated cables 23 connected with the inputs and/or outputs 26 may run to a sensor means 44 arranged on a load 42 in order to receive sensor signals, which provide information about the operational state of the load 42. On the basis of such feedback signals the electronic central unit 14 may then pass corresponding control signals to the valve means 34 of the respective fluid control module 5.

The electronic central unit 14 may if required be provided with a memory programmed control (SPS), so that the control device 1 has its own intelligence to set the course of operation, possibly involving matching with the connected external electronic control means 17.

With the exception of the measures for the provision of differently designed and differently arranged inputs and/or outputs 26 and feed fluid line connections 35 and 36, all connection modules 4 and fluid control modules 5 preferably possess identically designed module housings 45. Such a module housing 45 is in the working example box-like in design and possesses an open bottom side 27, which in the mounted state faces the respective component mounting area 3. In the interior of the module housing 45 of the connection modules 4 there is a preferably plate-like connection means substrate 46—preferably in the form of a circuit board—which bears the connection means 32 for the inputs and/or outputs 26 and is fitted with the associated second electrical central interface 23, the electrical connections being produced by the use of printed wiring on the connection means substrate 46. In its top housing wall at the top side 28 the module housing 45 has several openings, through which the electrical connection means 32 are accessible and/or through which same may extend to the outside.

In the case of the fluid control modules 5 all load fluid line connection 36 are preferably seated on the top side 28 or, respectively, the top housing wall provided there of the module housing 45. Here a relatively large area is available for the arrangement of a large number of load fluid line connections 36. At least one feed fluid line connection 35 and preferably furthermore a venting connection 43 are on the contrary placed to the side on side walls 47 of the module housing 45 which are at a right angle to the principal axis 6. The valve means 34 is seated in the interior of the module housing 45 and is screened off from the surroundings. The making of electrical contact is preferably by means of a circuit board 48 installed at the open bottom side of the module housing 45 of the fluid control module 5. When the fluid control module 5 is in position the board 48 is a small distance above the associated component mounting area 3, it making electrical contact with the valve means 34, and furthermore carrying the second electrical central interface 23 of the respective fluid control module 5. The board 48 can for example be detachably secured in place by detent means 51 for example on the module housing 45.

The valve means 34 is arranged above the circuit board 48, on which it can be directly fixed. It possesses a plurality of valve units 52 which are respectively composed of a fluid operated principal valve 53 and at least one electrically controlled pilot valve 54 for the operation of the principal valve 53. Particularly compact dimensions are possible if pilot valves 54 are designed in the form of piezoelectric valves.

Respectively two feed fluid line connections 35 are connected a principal valve 53. The feed fluid line connection 35 and furthermore any venting connection 43 present are each simultaneously connected with all principal valves 53. In the interior of the valve means 34 pressure medium is tapped in a manner (not illustrated) from the feed fluid line connection 35 and passed to the individual pilot valves 54 so that the same, by the controlled action of fluid, may set the switching position of the respectively, associated principle valve 53.

The wiring 55 of the circuit board 48 provides the electrical-connection with the associated second electrical central interface 23 with the individual electrically operated pilot valves.

Instead of the modular design of the valve means 43 as described there is also the possibility of providing the principal valves 53 jointly in a valve board and providing the same with the pilot valves 54.

Since each fluid control module 5 is provided with its own feed fluid line connection 35, the control device 1 may if required be provided with a plurality of fluid control modules 5 into which the fluid is caused to flow with a differing operational pressure. This renders operation with different pressure potentials readily possible.

Furthermore it is readily possible to provide a plurality of fluid control modules 5, which differ as regards their customization for enabling fluid control. For instance, the fluid control modules 5 may be provided with different valve means 34. The basis 2 may if necessary be fitted with differently tailored fluid control modules 5, whose fitting in position is possible on each of the component mounting areas 3.

Both in the case of the connection modules 4 and also in the case of the fluid control modules 5 the internal wiring preferably serves only for the transmission of the signals from the second electrical central interface 23 to the connection means 32 and, respectively, to the pilot valves 54. The manner of control may be st in accordance with needs individually in the electronic circuitry units 24, it being advantageous if all electronic circuitry units 24 present have a standard structure.

As regards the valve means 34 there is furthermore the possibility of providing valves with a minor functionality and operating the same with major functionalities by having a suitably individualized control system or means. Thus for example in a fluid control module 5 eight valve units with a 3/2 functionality could be provided, which by suitable programming of the control could be so matched in their manner of operation that they would perform the function of four valves with a 5/2 or 5/3 functionality.

When a fluid control module 5 is installed on a component mounting area, the valve means 34 produced will be shut off from the surroundings, whereas at the same time the various fluid line connections 35 and 36 will be readily accessible from the outside.

Each electronic circuitry unit 24 may be provided with optical display means 56, which optically provide information as regards the instantaneous operational state of the respectively module 4 and 5. Display zones 57 cooperating with the optical display means 56 in the wall of the module housing 45—for example where areas of the wall are transparent—render good visibility possible from the outside.

The fluid line connections 35, 36 and 43 are preferably designed in the form of plug connections. An fluid line to be connected, as for example a pressure medium hose, then only needs to be plugged in. For detaching it again a release element of the respective fluid line connection is operated for a short time.

The base housing 7 may in principle be integral. It is however and advantage for there to be a subdivision into separate housing segmented 57, which may be put together modularly in the direction of the principal axis in order to be able produce an individually design of control device 1 as may be required.

What is claimed is:

1. A control device comprising:

a base, on which at least one component mounting area is provided, said base being equipped with a first electrical central interface connected with an internal electrical bus extending in the base, and at least one electrical connection module having electrical inputs or outputs permitting a temporary connection of electrical cables which lead away from the control device, said connection module being selectively mountable on the at least one component mounting area and having a second electrical central interface adapted to automatically make contact and, respectively, interrupt contact with the first electrical central interface upon mounting and removal of the electrical connection module; and at least one electrically controlled fluid control module selectively mountable instead of the electrical connection module on the at least one component mounting area of said base, said fluid control module including an electrical circuit board provided with a second electrical central interface adapted during mounting and removal of the fluid control module to automatically make contact and, respectively, interrupt contact with the first electrical interface of the base, the fluid control module furthermore having an internally mounted electrically operated valve means connected to said circuit board and fluid line connections accessible from the outside for the temporary connection of fluid lines coming from a pressure source and fluid lines leading to at least one load, said electrically operated valve means being adapted to control the connection between different ones of said fluid line connections based on control signals received from said internal bus.

2. The control device as set forth in claim 1, wherein on the base a plurality of component mounting areas are defined each having a first electrical central interface, same being able to be fitted selectively with a connection module or a fluid control module.

3. The control device as set forth in claim 2, having a plurality of component mounting areas lying arranged in a row direction in sequence and in a common plane of extent.

4. The control device as set forth in claim 1, wherein the first and second electrical central interfaces are designed in the form of complementary plug connectors.

5. The control device as set forth in claim 1, wherein the fluid control module is adapted to be mounted with a bottom side thereof to the fore on the component mounting area, the second electrical central interface being located on the bottom side.

6. The control device as set forth in claim 5, wherein all load fluid line connections provided for the connection of at least one load are located on the top side facing away from the associated component mounting area of the mounted condition.

7. The control device as set forth in claim 5, wherein all fluid feed line connections, provided for the connection of a pressure medium source, are laterally placed.

8. The control device as set forth in claim 1, wherein the valve means of the at least one fluid control module possesses a plurality of valve units, which respectively are composed of a principal valve controlling the load fluid line connections and at least one electrically operated pilot valve serving for operating the principal valve.

9. The control device as set forth in claim 8, wherein at least one pilot valve is in the form of a piezoelectric valve.

10. The control device as set forth in claim 1, wherein all fluid control modules possess identically designed module housings apart from the measures relating to the inputs or outputs and the fluid line connections.

11. The control device as set forth in claim 1, wherein the fluid control module possess a module housing, in which the valve means are so accommodated that the module housing covers over the valve means in a mounted state on a component mounting area, the fluid line connections being provided on the module housing to be accessible from the outside.

12. The control device as set forth in claim 1, wherein the internal electrical bus is connected with an electronic central unit located on the control device, such central interface having at least one electrical interface for the connection of an external electronic control means.

13. The control device as set forth in claim 12, wherein the electronic central unit contains a memory programmed control system.

* * * * *